US007726378B1

(12) United States Patent
Savon

(10) Patent No.: US 7,726,378 B1
(45) Date of Patent: Jun. 1, 2010

(54) DOOR SUPPORTED FOR MOVEMENT ON TRACKS BETWEEN FULL AND PARTIAL OPEN AND CLOSED POSITIONS

(76) Inventor: Felix S. Savon, 3845 Sugarbush Dr., Canfield, OH (US) 44406

( * ) Notice: Subject to any disclaimer, the term of this patent is extended or adjusted under 35 U.S.C. 154(b) by 0 days.

(21) Appl. No.: 12/424,673

(22) Filed: Apr. 16, 2009

Related U.S. Application Data

(62) Division of application No. 11/218,393, filed on Aug. 31, 2005, now abandoned.

(51) Int. Cl.
*E05D 15/12* (2006.01)
*E05D 7/12* (2006.01)
*E06B 3/48* (2006.01)

(52) U.S. Cl. ..... 160/201; 160/229.1; 160/113; 16/258

(58) Field of Classification Search ..... 160/205, 160/201, 180, 115, 116, 229.1; 16/90, 91, 16/102, 106, 326, 327, 231, 232, 254, 257, 16/258, 270, 271, 272; 292/57–62, 67, 69, 292/71, 153, 156, DIG. 13, DIG. 36
See application file for complete search history.

(56) References Cited

U.S. PATENT DOCUMENTS

| | | | | | |
|---|---|---|---|---|---|
| 223,624 | A | * | 1/1880 | De Witt | 292/57 |
| 464,201 | A | * | 12/1891 | Rowland | 242/599.3 |
| 1,036,583 | A | * | 8/1912 | Diedrich | 292/162 |
| 1,172,512 | A | | 2/1916 | Angelovich | |
| 1,469,525 | A | | 10/1923 | Nadolney | |
| 1,904,110 | A | * | 4/1933 | Willmann | 49/371 |
| 2,525,309 | A | | 10/1950 | Norberg | |
| 2,557,716 | A | | 6/1951 | Allee | |
| 2,655,683 | A | | 10/1953 | McKee et al. | |
| 3,376,913 | A | | 4/1968 | Clapsaddle | |
| 3,436,860 | A | | 4/1969 | James | |
| 3,484,812 | A | | 12/1969 | Holland | |
| 3,671,998 | A | * | 6/1972 | Ruiz | 16/229 |
| 3,978,618 | A | * | 9/1976 | Malo | 49/449 |
| 4,016,920 | A | | 4/1977 | Shepard | |
| 4,115,900 | A | | 9/1978 | Mihalcheon | |
| 4,119,133 | A | | 10/1978 | Wolf | |
| 4,231,412 | A | | 11/1980 | Nowak | |

(Continued)

OTHER PUBLICATIONS

Website pages showing breakaway panels manufactured by Thruways Door Systems, Inc. of 400 Poplar Street, Pittsburgh, PA. (date unknown).

*Primary Examiner*—Katherine W Mitchell
*Assistant Examiner*—Jaime F Cardenas-Garcia
(74) *Attorney, Agent, or Firm*—Robert J. Herberger

(57) ABSTRACT

A door assembly includes multiple door panels arranged in series along laterally spaced tracks, extending laterally between the tracks, and supported for movement on the tracks. A first pair of hinge plates is secured to a first door panel, each member of the first pair being located at an opposite lateral side of the first panel. A second pair of hinge plates is secured to a second door panel, each member of the second pair being located at an opposite lateral side of the second panel. A first release pin alternately disconnects and connects the first and second hinge plates at the first lateral side of the door panels. A second release pin alternately disconnects and connects the first and second hinge plates at the second lateral side of the door panels.

4 Claims, 7 Drawing Sheets

U.S. PATENT DOCUMENTS 4,378,043 A 3/1983 Sorenson
4,455,711 A * 6/1984 Anderson ..... 16/229
4,505,501 A * 3/1985 Fuchs et al. ..... 292/62
4,537,237 A 8/1985 Sepulveda et al.
4,570,290 A * 2/1986 Anderson ..... 16/229
4,574,860 A 3/1986 Weiss
4,653,566 A 3/1987 Miale
4,673,019 A 6/1987 Silverthorne
4,676,293 A 6/1987 Hanssen
4,949,772 A 8/1990 Ballyns et al.
4,997,218 A * 3/1991 Culling ..... 292/60
5,050,660 A 9/1991 Bleichwehl et al.
5,231,734 A 8/1993 Rude
5,235,724 A 8/1993 Perrin et al.
5,274,882 A * 1/1994 Persson ..... 16/303
5,358,025 A 10/1994 Wood
5,408,789 A 4/1995 Plfeger
5,427,169 A 6/1995 Saulters
5,535,805 A 7/1996 Kellogg et al.
5,584,333 A 12/1996 Torchetti et al.
5,611,382 A 3/1997 Sferra
5,720,332 A 2/1998 Nachreiner
5,727,614 A 3/1998 Lichy
5,765,622 A 6/1998 Lichy
5,848,630 A 12/1998 Manzo
5,887,385 A 3/1999 Horner et al.
5,896,704 A 4/1999 Neag et al.
5,904,199 A 5/1999 Messner
5,937,480 A 8/1999 Kiefer
6,041,478 A * 3/2000 Martin ..... 16/385
6,092,580 A 7/2000 Lucas
6,148,897 A 11/2000 Horner et al.
6,315,027 B1 11/2001 Lichy
6,374,551 B1 4/2002 Boilen et al.
6,574,832 B1 6/2003 Boerger et al.
6,578,619 B2 6/2003 Wright
6,626,256 B2 9/2003 Dennison et al.
6,729,380 B2 5/2004 Whitley et al.
7,201,207 B2 4/2007 Colston et al.
2002/0179254 A1 12/2002 Schulte
2005/0081737 A1 4/2005 Smallwood
2005/0251958 A1 11/2005 Coblentz et al.
2006/0065374 A1 3/2006 Colston et al.
2007/0039131 A1 2/2007 Rude

* cited by examiner

DOOR SUPPORTED FOR MOVEMENT ON TRACKS BETWEEN FULL AND PARTIAL OPEN AND CLOSED POSITIONS

This application is a divisional of U.S. patent application Ser. No. 11/218,393, filed Aug. 31, 2005 now abandoned, the full disclosure of which is incorporated herein by reference.

BACKGROUND OF THE INVENTION

The present invention relates to the field of doors and other closures supported on rollers and guided in tracks. More particularly, the invention pertains to such doors formed of hinged panels, each panel alternately connected to and separated from the other panels.

Doors for opening and closing openings in garages, sheds and other storage spaces are usually formed of panels that extend laterally between tracks located at opposite sides of the opening. The panels, arranged in a series, each carry rollers at each lateral side. The rollers are supported on the tracks, which guide movement of the door panels as the door is opened and closed. Each track includes a horizontal length located above the opening, a vertical length parallel to the sides of the opening, and an arcuate transition section connecting the horizontal and vertical lengths.

The panels carry hinges, which interconnect the panels so that the door panels move as a unit along the tracks and articulate about the axis of the hinge pin when the door passes along the transition section.

Doors of this kind are either fully opened or fully closed. When the door is open, the door panels are in the horizontal track length; when closed, the lower panel is supported on the ground and all the panels are in a vertical plane filling the opening.

There is a need for a door of this kind to be partially open and partially closed so that it allows ventilation, provides a line of sight through the opening, and prevents the entrance of animals, wind-blown debris, and other unwanted objects.

SUMMARY OF THE INVENTION

A door, according the present invention, can be fully open and fully closed manually or with use of remotely controlled automatic opening and closing equipment.

The door can also be partially opened such that some of the upper door panels are raised along supporting tracks into a horizontal plane over the opening, and lower door panels rest on the ground in a vertical plane providing an opening between the upper, open panels and the and lower, closed panels. Split hinges are manipulated to disconnect adjacent door panels, thereby determining the location the opening. The size of the opening is controlled by adjusting the location of the raised panels.

To disconnect adjacent door panels, a release pin is removed from the hinges at each side of the door; to reconnect the door panels, the release pin reengages the hinges. A quick connect/release pin provides a continuous elastic biasing force to assist the operator in performing these operations.

To prevent roller interference at the transition radius, each roller can be supported on the respective hinge with a resilient suspension that continually urges the roller toward the supporting track, thereby ensuring continuous support of the door on the tracks and automatically increasing the space between adjacent rollers at the transition.

The release pins are readily engaged and disengaged manually by an operator, and the hinge plates are formed so they are guided into their correct position before being engaged.

A door assembly, according to the present invention, includes multiple door panels arranged in series along laterally spaced tracks, extending laterally between the tracks, and supported for movement on the tracks. A first pair of hinge plates is secured to a first door panel, each member of the first pair being located at an opposite lateral side of the first panel. A second pair of hinge plates is secured to a second door panel, each member of the second pair being located at an opposite lateral side of the second panel. A first release pin alternately disconnects and connects the first and second hinge plates at the first lateral side of the door panels. A second release pin alternately disconnects and connects the first and second hinge plates at the second lateral side of the door panels.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
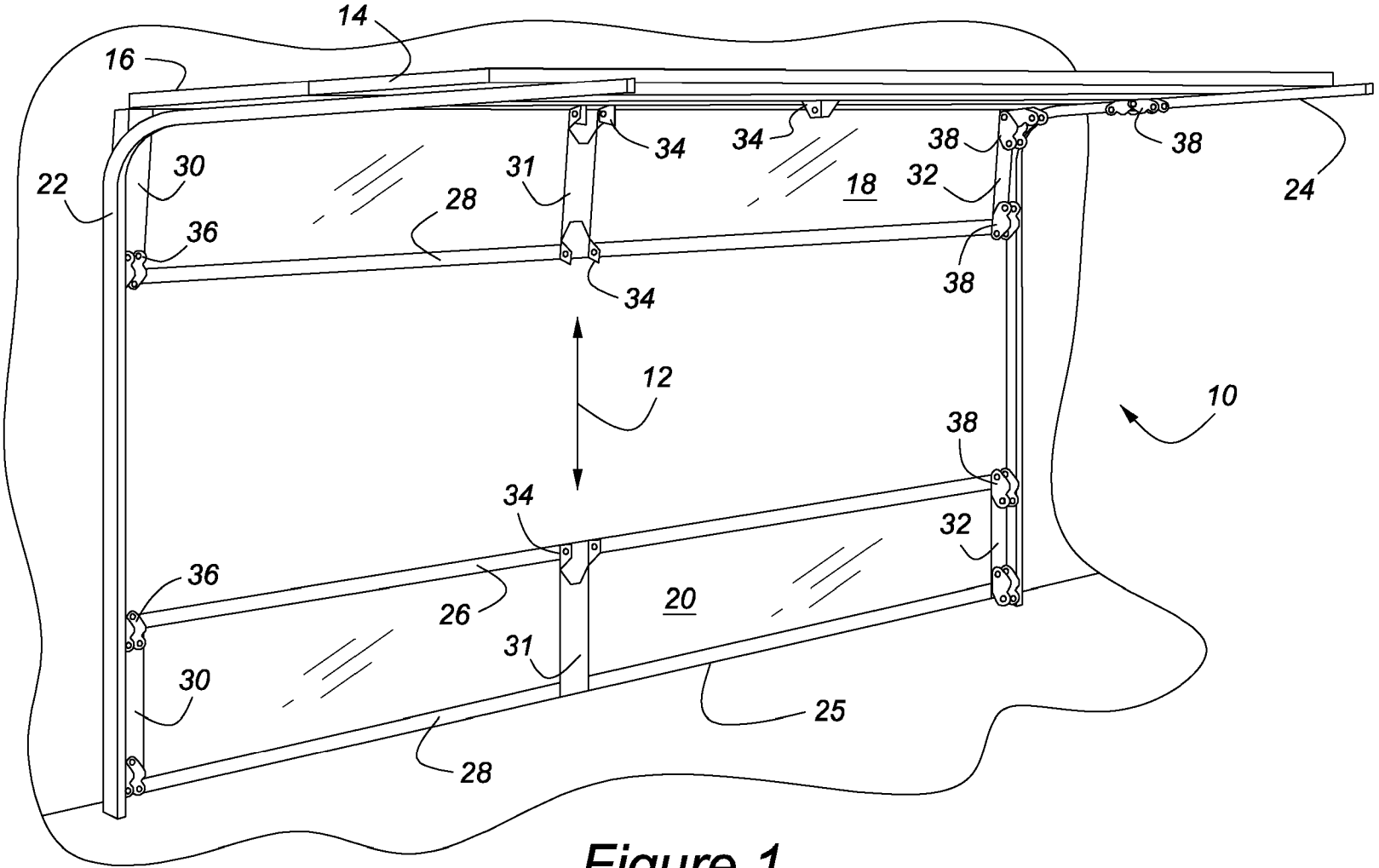
FIG. 1 is a perspective view of the interior surface of a garage door showing the door partially open at door panels separated by split hinges.

Referring to the drawings, FIG. 1 shows the interior surface of a door 10 fitted with split hinges located at the door's lateral edges and at a center longitudinal axis 12. The door 10 shown in the figures is a garage door, although a door according to this invention may be used to open and close any suitable opening.

The door 10 is formed in consecutive sections or panels 14, 16, 18, 20, which extend laterally between tracks 22, 24 located, respectively, at the left-hand side and right-hand side of an opening that is closed and opened by the door. The door 10 carries rollers at each lateral edge, each roller being fitted into one of the tracks 22, 24, which support the door and guide its travel along a vertical and horizontal path defined by the tracks. Each door panel 14, 16, 18, 20 extends longitudinally along axis 12 when the door is fully closed. Adjacent panels are mutually interconnected and hinged to permit the door to follow the curvature of the tracks 22, 24 as the door is raised and lowered.

When the door 10 is fully open, it lays in a substantially horizontal plane supported on the tracks 22, 24 over the opening. When the door 10 is fully closed, it occupies a vertical plane in the opening and its lower edge 25 rests on the ground. As FIG. 1 illustrates, the door 10 may also be partially open such that the upper door panels 14, 16 are raised into a horizontal plane supported on the tracks over the opening, the lower panel 20 is in a vertical plane resting on the ground, and a space between panels 18 and 20 is open. Depending on the location where the panels are separated to provide the partially opened condition, some of the upper panels 14, 16 may be in the horizontal plane and panel 18 may be in a vertical plane connected to panel 16 but separated from the lower panel 20, thereby providing an opening between panels 18 and 20.

Preferably each door panel 14, 16, 18, 20 is reinforced with an upper horizontal stiffener 26 and a lower horizontal stiffener 28, a vertical stiffener 30 located at the left-hand door edge, a vertical stiffener 31 located at the center, and a vertical stiffener 32 located at the right-hand door edge.

A pair of centrally located split hinges 34 alternately connects and disconnects adjacent panels at the center axis 12 of the door 10. A pair of split hinges 36 alternately connects and disconnects adjacent panels at the left-hand door edge. A pair of split hinges 38 alternately connects and disconnects adjacent panels at the right-hand door edge.

Figure 2:
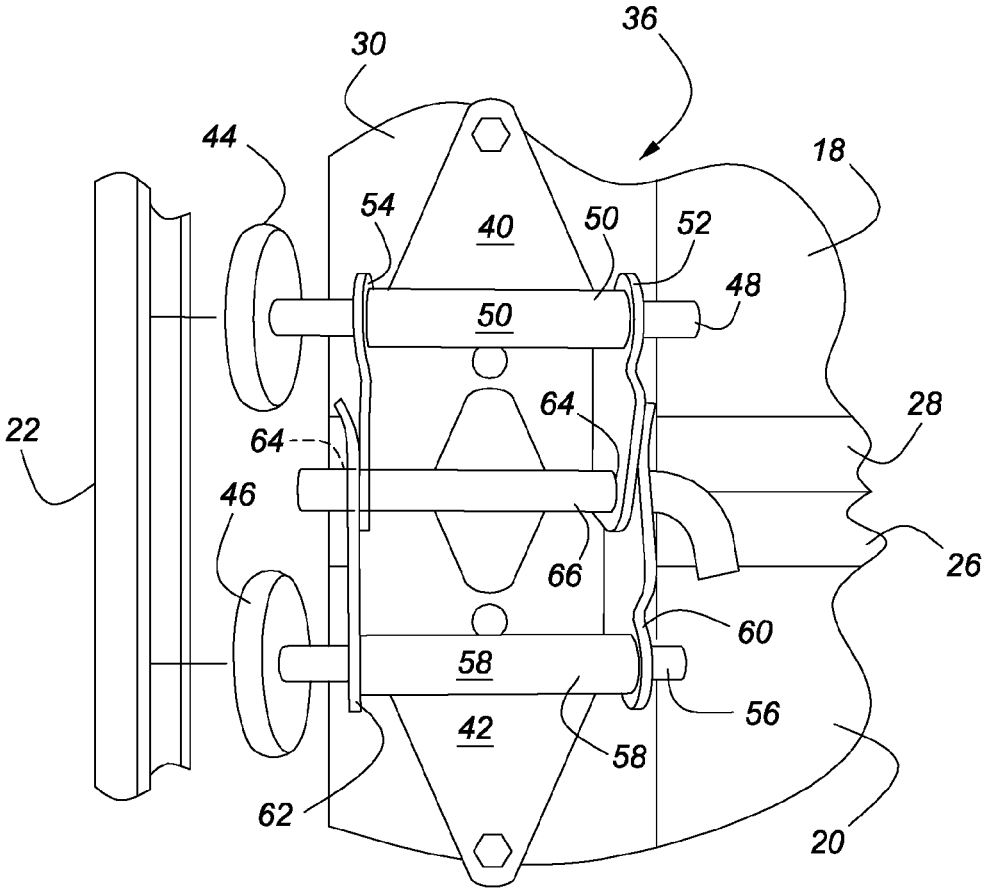
FIG. 2 is a top view of a split hinge, according to this invention, located at the left-hand door track and connecting adjacent door panels.
Figure 3:
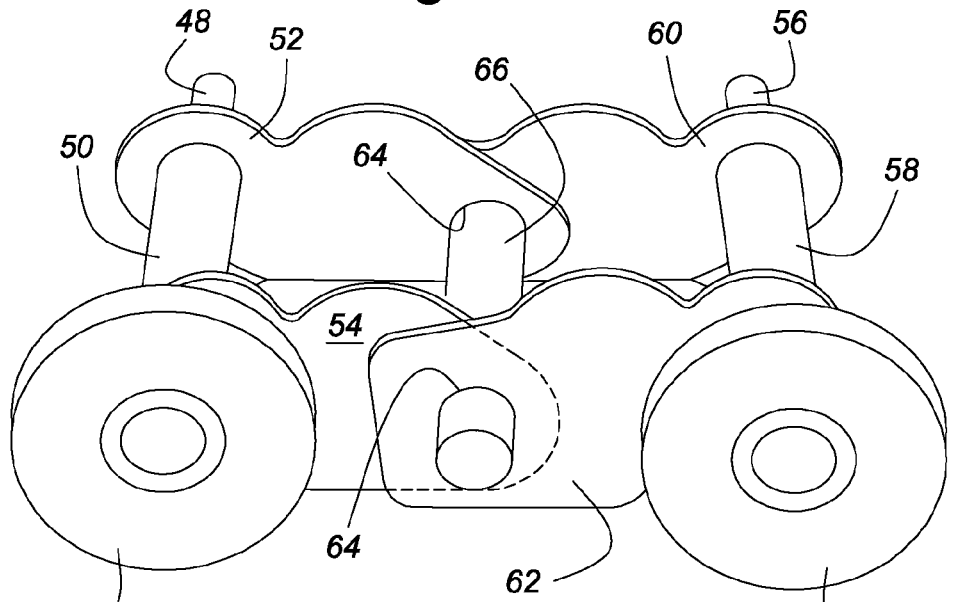
FIG. 3 is a perspective side view of the split hinge of FIG. 2.

The split hinges 36 at the left lateral door edge are illustrated in FIGS. 2 and 3. Hinge 36 includes an upper hinge plate 40, in the form of a channel with a face plate securely attached to stiffener 30 and door panel 18; a lower hinge plate 42, in the form of a channel with a face plate securely attached to the stiffener 30 and door panel 20; an upper roller 44, supported on the legs of the upper hinge plate 40 and fitted into track 22; and a lower roller 46, supported on the legs of the lower hinge plate 42 and fitted into track 22.

Roller 44 is rotatably supported on the end of a shaft 48, which extends laterally rightward from roller 44 through a sleeve 50 and mutually aligned holes formed in the legs 52, 54 of upper hinge plate 40. Similarly, roller 46 is rotatably supported on a shaft 56, which extends laterally rightward from roller 46 through a sleeve 58 and mutually aligned holes formed in the legs 60, 62 of lower hinge plate 42. Channel legs 52, 54 of the upper hinge plate 40 extend downward toward the lower hinge plate 42, whose legs 60, 62 extend upward toward the upper hinge plate 40. Leg 52 passes within leg 60, leg 54 passes within leg 62, and mutually aligned holes 64 are formed in the legs 52, 54, 60, 62 in the area of the overlap. The upper ends of the legs 60, 62 of the lower hinge plate 42 are flared outward laterally to guide movement of the legs 52, 54 of the upper hinge plate 40 into their proper position when the door closes the opening between panels 18 and 20.

When the door panels 16, 18 are connected by hinge 36, a cylindrical release pin 66 is fitted through the holes 64, thereby connecting the upper and lower hinge plates 40, 42 and permitting the adjacent door panels 18, 20 to articulate about the axis of the pin as the door travels on the track 22. When the release pin 66 is installed in the split hinge plates 40, 42, it is disposed parallel to the horizontal edges of the adjacent door panels and it is aligned with those door edges.

The split hinges 38 at the right-hand door edge (shown in FIG. 1) are substantially the same as split hinges 36, except that they are of the opposite hand and are supported on track 24.

Figure 4:
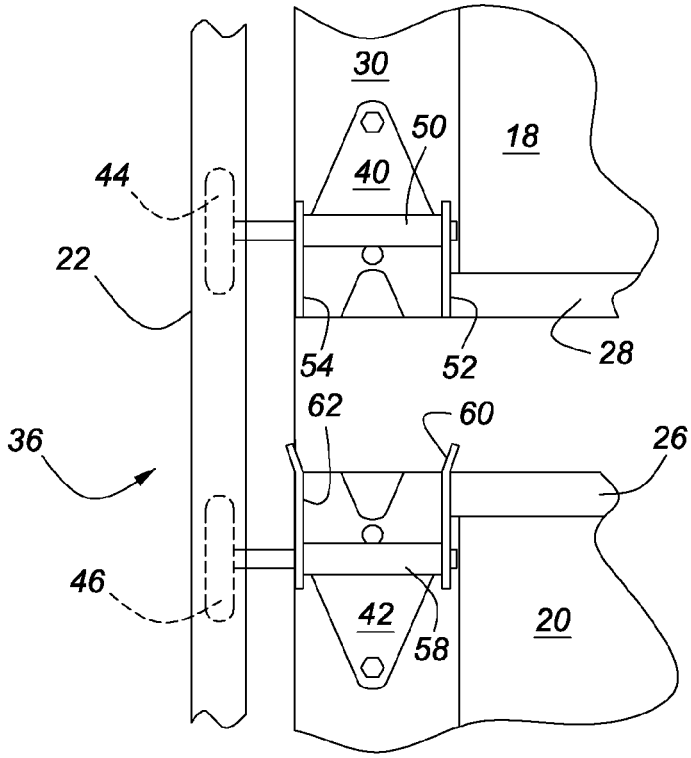
FIG. 4 top view of the split hinge located at the left-hand door track showing the adjacent door panels disconnected by the hinge.

When the release pin 66 is removed from the split hinge pairs 36, 38 at the lateral edges of the door and a release pin is removed from the split hinge pair 34 at the center of the door, panel 18 is disconnected from panel 20. The upper panels 18, 16, 14 can then be raised as a unit while mutually connected, and the lower panel 20 can be supported on the floor, thereby partially opening the door 10. FIG. 4 shows split hinge 36 with its release pin 66 removed and door panel 18 raised from panel 20. The opening can be located between any two of the door panels by removing the release pins from the selected door panel interface.

Figure 5:
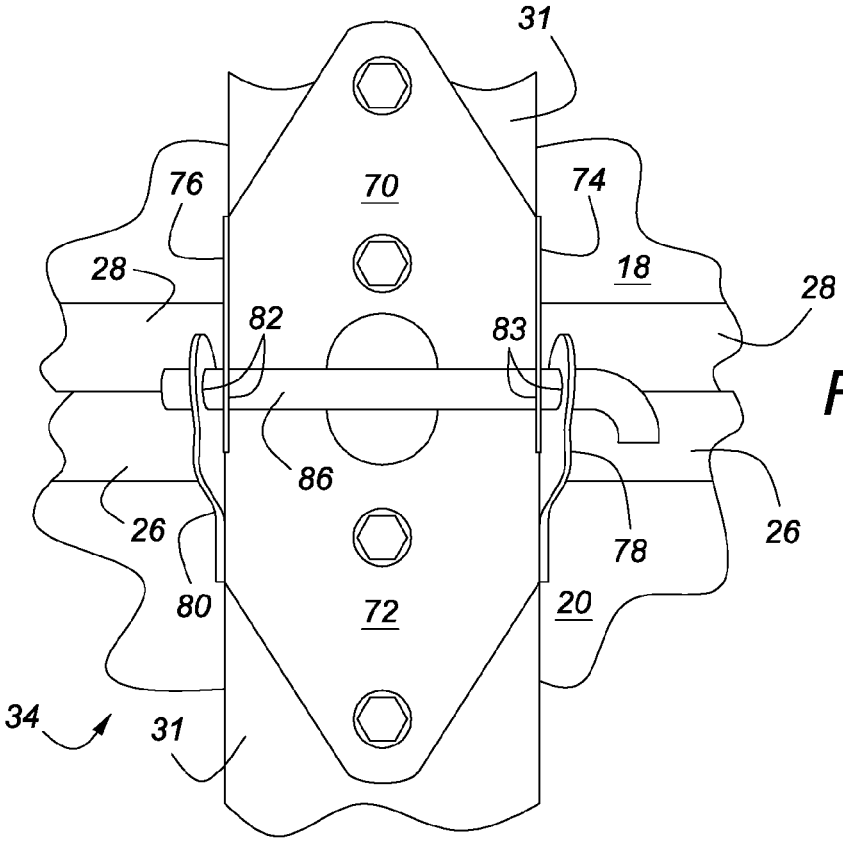
FIG. 5 is a top view of a split hinge located at the center of the door of FIG. 1 and connecting the adjacent door panels.

FIG. 5 illustrates a split hinge 34 of the type located at the center of the door 10, secured to panels 18, 20 and the central stiffener 31. Each of the center split hinges 34 includes an upper hinge plate 70 secured to the stiffener 31, and a lower hinge plate 72 secured to stiffener 31. Legs 74, 76 of the upper hinge plate 70 extend downward toward the lower hinge plate 72, whose legs 78, 80 extend upward toward the upper hinge plate 70. Leg 78 overlaps leg 74, leg 80 overlaps leg 76, and mutually aligned holes 82, 83 are formed in the legs in the areas of the overlaps. A release pin 86, fitted through the holes 82, 83, secures the upper and lower hinge plates 70, 72 mutually and the adjacent door panels 18, 20. When pin 86 is installed in the hinge, pin 86 extends laterally parallel to the edges of the door panels, and it is aligned with the door edges. Pin 86 permits the door panels 18, 20 to articulate as the door moves along the tracks 22, 24. The upper ends of the legs 78, 80 of the lower hinge plate 72 are flared outward laterally to guide movement of the legs 74, 76 of the upper hinge plate 70 into their proper position when the door closes the opening between panels 18 and 20.

Figure 6:
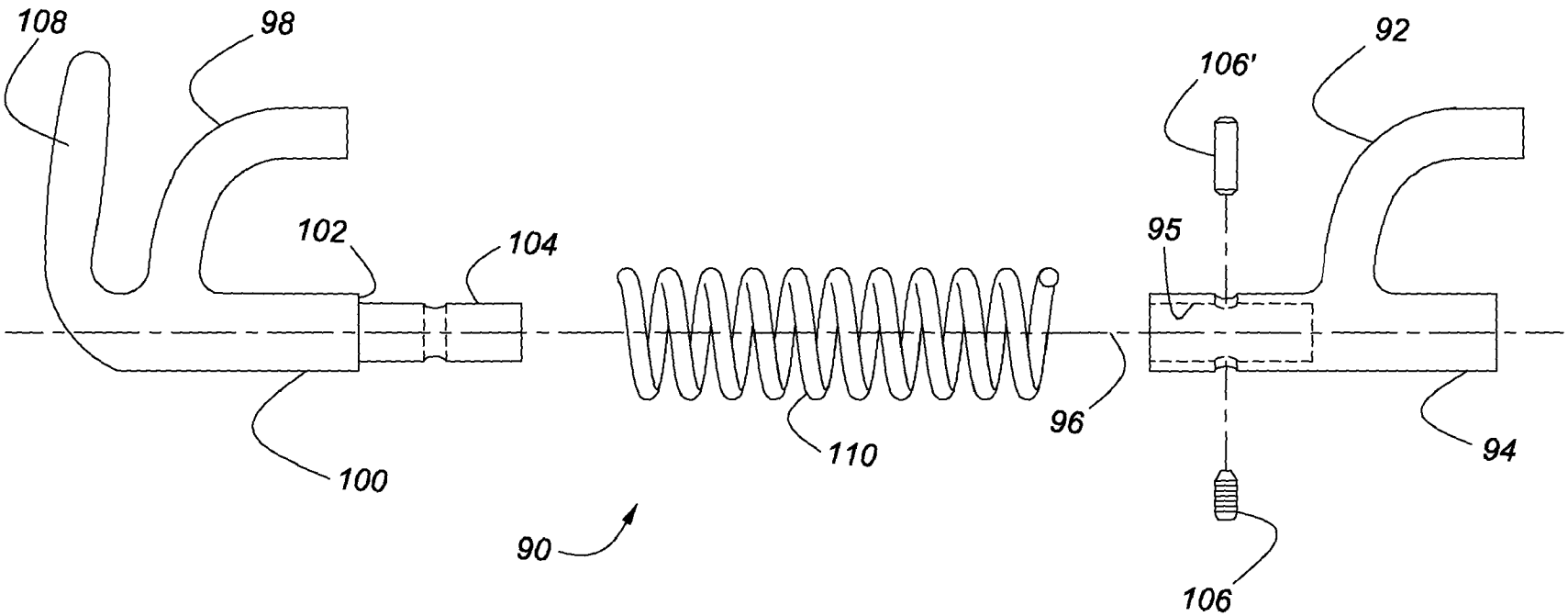
FIG. 6 is a side view of a quick release pin for use with the split hinges.

A quick-release pin 90, which may be substituted for release pin 66 in the split hinges 36, 38, is illustrated in FIG. 6, which shows the release pin 90 disassembled before assembly in its split hinge with the parts arranged in their installed position. An outboard latch 92, located laterally outward toward the door edge when the pin 90 is installed, extends radially and laterally from a latch pin 94, which is formed along a portion of its length with a bore 95 directed along an axis 96 of the pin 94. An inboard latch 98, located laterally inward from the door edge when the pin 90 is installed, extends radially and laterally from a second latch pin 100 having a shoulder 102 and a reduced diameter portion 104, which extends axially from the shoulder 102. The reduced diameter portion 104 is sized to fit in the bore 95 of latch pin 94.

The latch pins 94, 100 are secured mutually by inserting a threaded set screw or pin 106 and 106', respectively, in aligned radial holes formed in the bored length portion of latch pin 94 and in the reduced diameter portion 104 of latch pin 100.

The end of latch pin 100 is formed with radial handle 108, which facilitates manually rotating the pin 90 when it is installed in its split hinge. A compression spring 110 bears against the outboard latch 92 and against the inboard channel leg 54 when the quick-release pin 90 is installed. The force produced by spring 110 continually urges the outboard latch 92 into engagement with the holes 64 in the overlapping outboard legs of the split hinge plates 40, 42.

Figure 7:
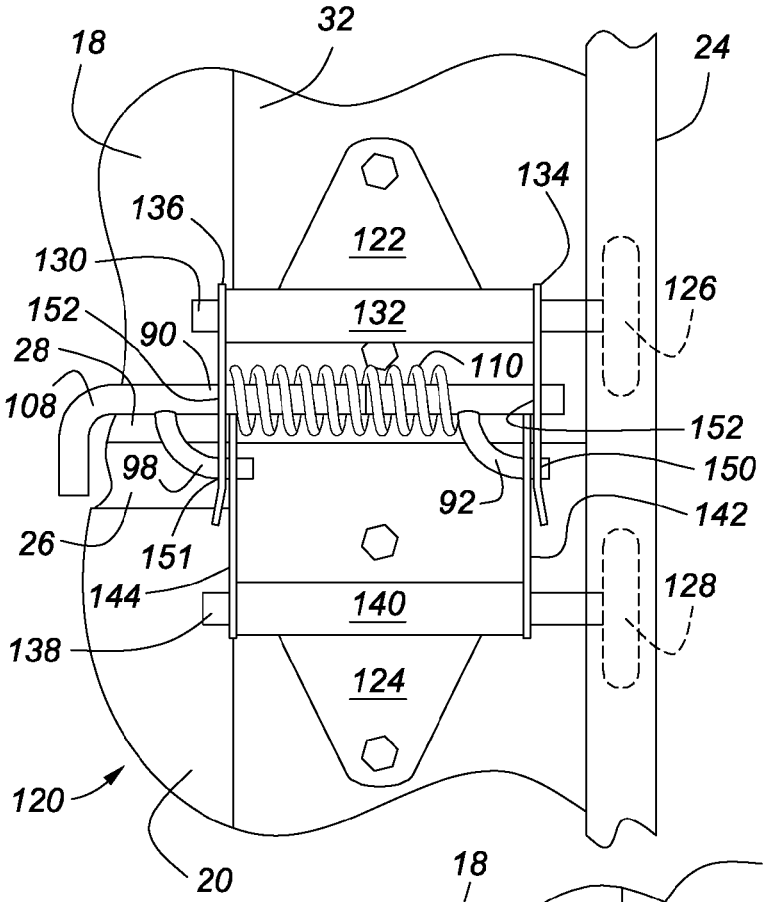
FIG. 7 is a top view of a split hinge located at the right-hand door track showing a quick-connect pin in the closed position connecting the adjacent door panels.
Figure 8:
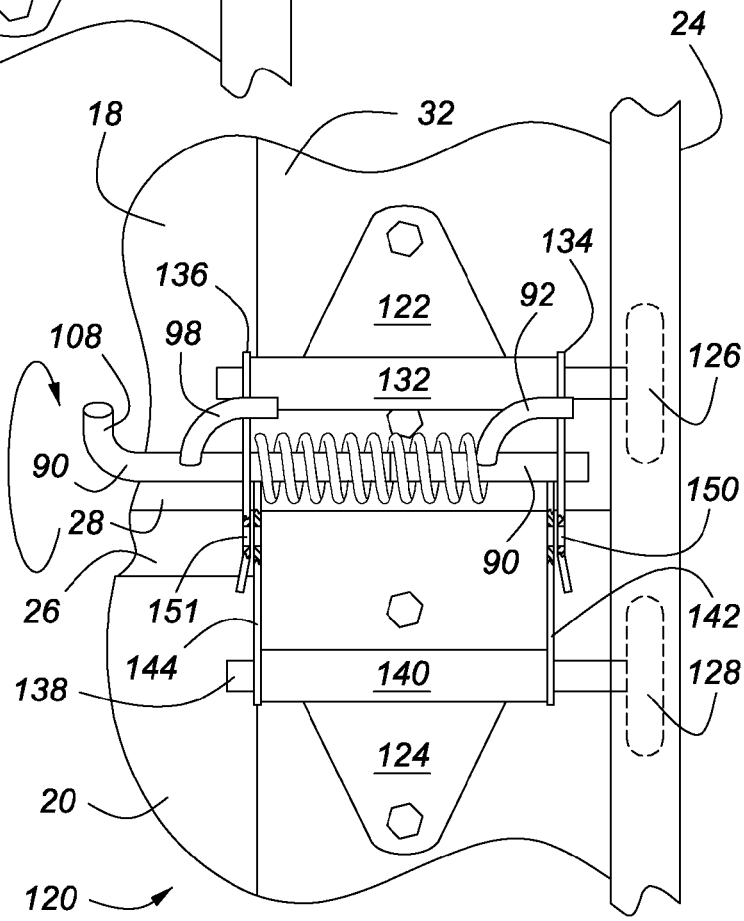
FIG. 8 is a top view of a split hinge located at the right-hand track showing a quick-connect pin in the open position having been disengaged from the split hinges.
Figure 9:
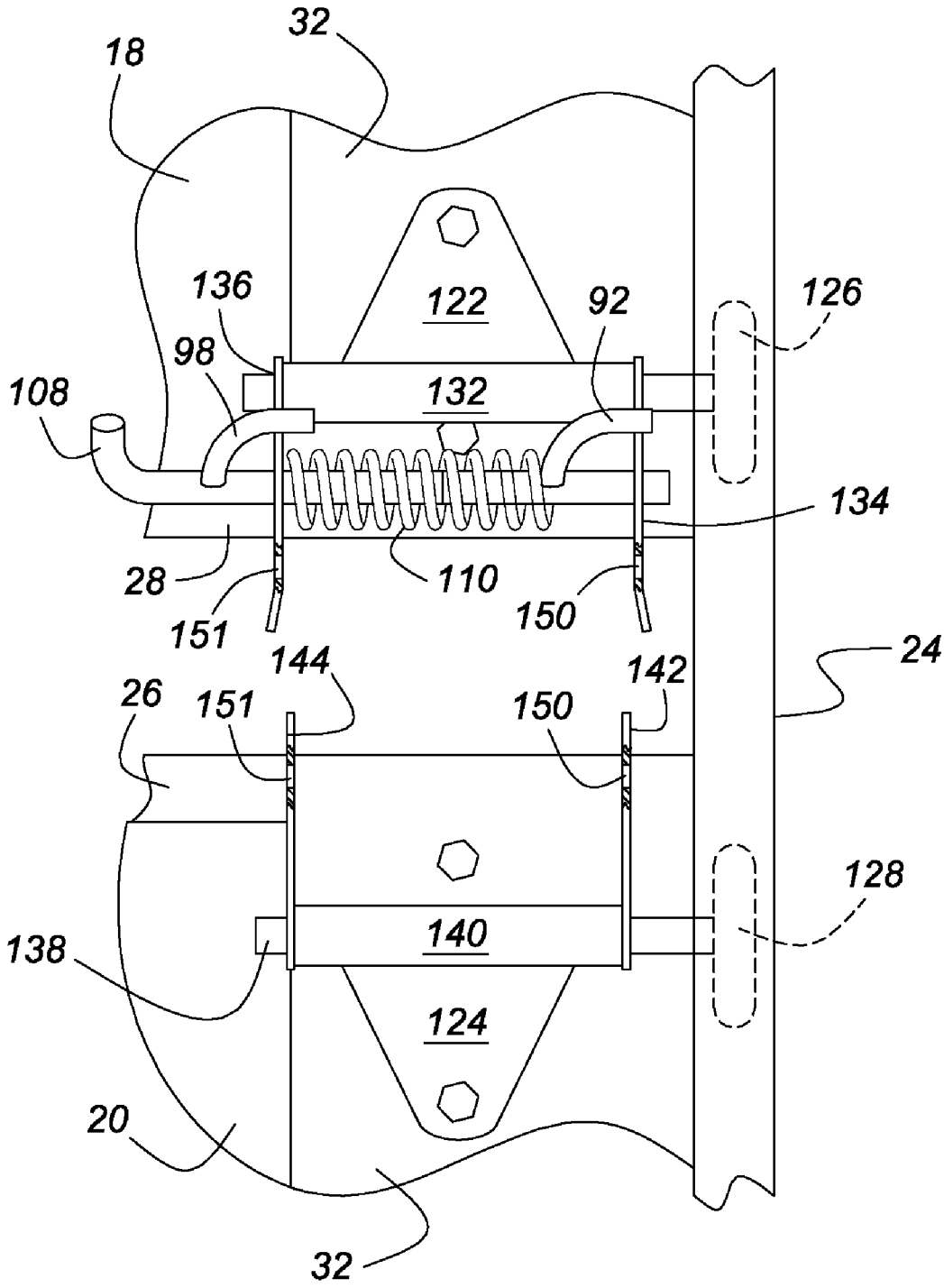
FIG. 9 is a front view of a split hinge located near the right-hand track of the door showing a quick-connect pin in the open position and the door panels having been moved apart.

A split hinge 120 for use with release pin 90 is illustrated in more detail in FIGS. 7-9 shown at the right-hand edge of the door 10 and secured to panels 18, 20. The split hinge 120 includes an upper plate 122 in the form of a channel securely attached to stiffener 32 and door panel 18; a lower plate 124 in the form of a channel securely attached to the stiffener 32 and door panel 20; an upper roller 126, supported on the legs of the upper channel plate 122 and fitted into track 24; and a lower roller 128, supported on the legs of the lower channel plate 124 and fitted into track 24.

Roller 126 is rotatably supported on the end of a shaft 130, which extends laterally leftward from roller 126 through a sleeve 132 and mutually aligned holes formed in the legs 134, 136 of the upper channel plate 122. Similarly, roller 128 is rotatably supported on a shaft 138, which extends laterally leftward from roller 128 through a sleeve 140 and mutually aligned holes formed in the legs 142, 144 of the lower channel plate 124. Channel legs 134, 136 of the upper channel plate 122 extend downward toward the lower channel plate 124, and whose legs 142, 144 extend upward toward the upper channel plate 122. Leg 134 overlaps leg 142, leg 136 overlaps leg 144. Similar to holes 82 and 83 shown in the split hinge 34 which is illustrated in FIG. 5, and holes 64 in split hinges 36 and 38 illustrated in FIGS. 2-4, with the substitute split hinges 122, 124 mutually aligned holes 150, 151 shown in FIGS. 7-9 are formed in the legs 134, 136, 142, 144 in the area of the overlap. The lower ends of the legs 134, 136 of the upper hinge plate 122 are flared outward laterally to guide movement of the legs 142, 144 of the lower hinge plate 124 into their proper position when the door closes the opening between panels 18 and 20.

Release pin 90 is supported on legs 134, 136 by inserting it into aligned holes 152 located between roller sleeve 132 and holes 150, 151. The holes 152, on which pin 90 is supported, are spaced from holes 150, 151 such that latch 92 can engage holes 150 and latch 98 can engage holes 151.

Release pin 90 is installed by the following preferred steps: (1) inserting latch pin 94 into hole 152 in channel leg 134, (2) inserting spring 110 between leg 136 and latch 92, (3) inserting latch pin 100 through hole 152 in the channel leg 136, (4) inserting the reduced diameter portion 104 into bore 95, and (5) securing the latch pins together using the pin 106' or set screw 106 such that latch 98 engages holes 151 when latch 92 is engaged with holes 150. FIG. 7 shows the release pin 90 installed in the split hinge assembly 120, which is in the closed position.

FIG. 8 shows the release pin 90 disengaged from the split hinge assembly 120. To disengage the release pin 90, the handle 108 is pulled leftward against the force of spring 110 sufficiently far such that latch 92 is removed from holes 150 and latch 98 is removed from holes 151. Then the handle 108 is rotated to the position shown in FIG. 8. The force of spring 110 pushes latch 92 toward channel leg 134 and pulls latch 98 toward channel leg 136, but the latch cannot engage the channel holes 150, 151 and the pin remains disengaged.

The release pin is reengaged by pulling the handle 108 leftward from the position shown in FIG. 8, rotating the handle to align latch 92 with channel holes 150 and latch 98 with channel holes 151, and releasing the handle to allow the spring 110 to urge the latches 92, 98 into their respective engagement holes 150, 151.

FIG. 9 shows the release pin 90 disengaged from the split hinge assembly 120, and the upper and lower channels plates 122, 124 of the split hinge assembly 120 separated to open a space between door panels 18 and 20.

Finally, it is important that the split hinge assembly avoids interference between the rollers that may occur where the track radius provides a transition between the horizontal length above the aperture and the vertical length beside the aperture, particularly where the track radius is relatively small, the panel height is large and/or the panels are heavy. Therefore, it may be necessary that the longitudinal spacing between the rollers 44, 46 carried on each pair of the split hinge plates 40, 42 be increased, and the rollers be elastically biased toward the respective track 22 as illustrated in the embodiment shown in FIG. 10.

Figure 10:
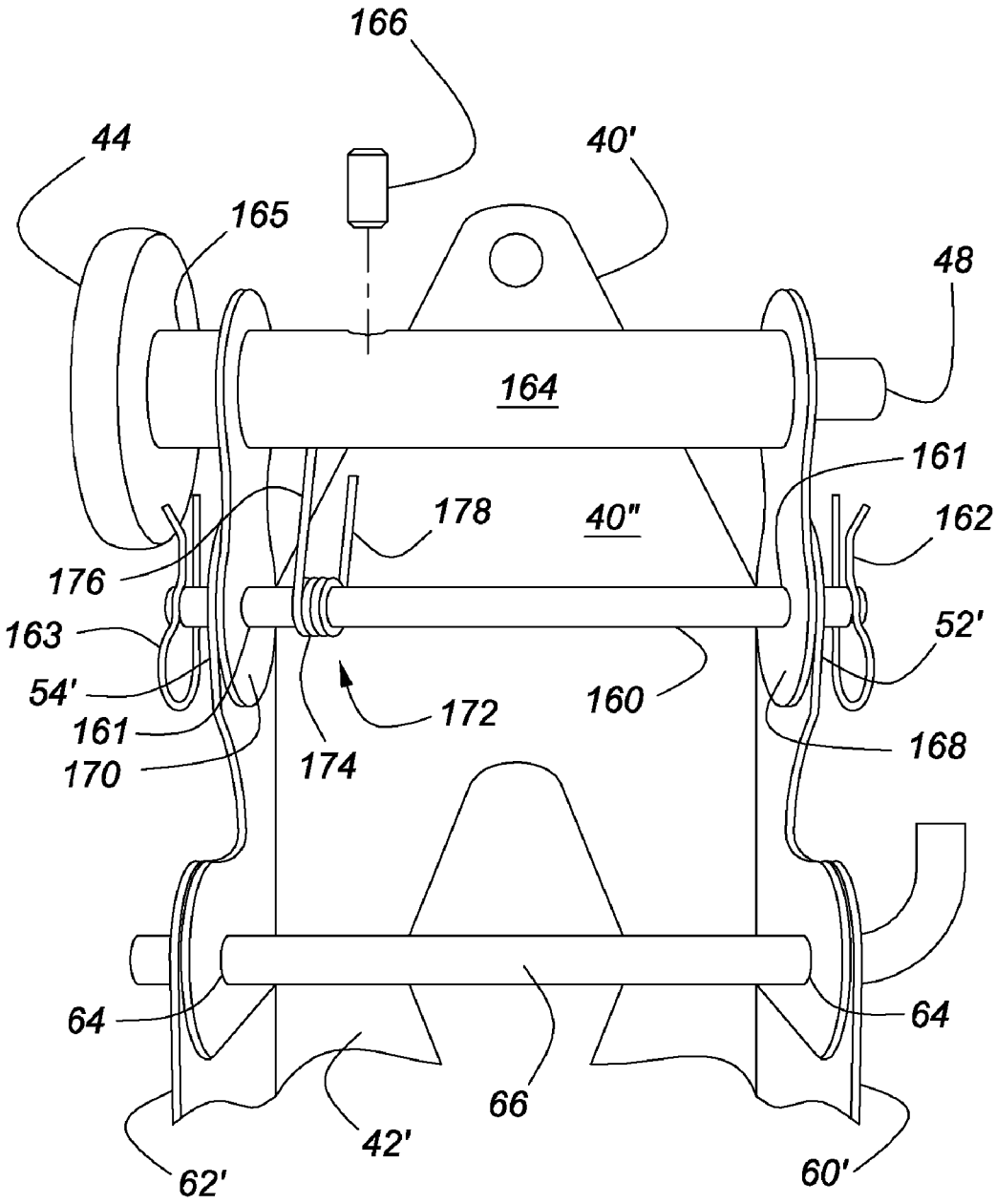
FIG. 10 is a top view of a split hinge located at the left-hand door track, connecting adjacent door panels, and elastically urging the rollers toward engagement with the track.

More specifically, viewing FIG. 10 the channel legs 52', 54' of hinge plate 40', having a hinge attachment plate 40", support a laterally directed pin 160 secured to the legs 52', 54' by latch pins 162, 163. Roller shaft 48 is fitted into a sleeve 164, which may be secured to shaft 48 by a pin or set screw 166 to establish the distance the roller 44 extends laterally from the hinge plate 40'. Further yet, a spacer 165 can be used to secure the minimal distance between the roller 44 and hinge plate 40', thereby additionally assuring that the roller 44 and corresponding panels 18, 20 do not bind with the track 22 during travel. The roller 44 is rotatably supported on shaft 48 by bearings (not shown) located between the outer surface of shaft 48 and a hub of the roller 44. Sleeve 164 is formed with two laterally spaced legs 168, 170, which extend from the axis of roller shaft 48 to pin 160. The legs are each formed with mounting pivot pin holes 161, by which the sleeve 164 and roller 44 are pivotably supported on pivot pin 160. A torsion spring 172 includes a loop 174, which encircles the shank of pivot pin 160, a first leg 176, which contacts sleeve 164 and urges roller 44 toward engagement with track 22, and a second leg 178, which contacts the surface of hinge attachment plate 40" and provides a force that reacts the force applied to sleeve 164.

Hinge plate 42' includes a similar arrangement to that illustrated in FIG. 10 for elastically biasing roller 46 toward engagement with track 22. Release pin 66 connects the overlapping legs 52', 54', 60', 62' through attachment pin hole 64 of the adjacent split hinge plates 40' and 42'.

The arrangement of FIG. 10 elastically supports each roller on its hinge plate 40' and continually urges the roller toward the supporting track, thereby ensuring continuous support of the door on the tracks and automatically increasing the space between adjacent rollers when the panel hinge assembly moves along the track transition section.

In accordance with the provisions of the patent statutes, the present invention has been described in what is considered to represent its preferred embodiments with the various modifications if and as necessary. However, it should be noted that the invention can be practiced otherwise than as specifically illustrated and described without departing from its spirit or scope.

What is claimed is:

1. A garage door assembly for an opening comprising:

first and second garage door panels;

a first pair of hinge plates secured to the first panel, each member of the first pair being located at one of respective first and second lateral sides of the first panel;

a second pair of hinge plates secured to the second panel, each member of the second pair being located at one of respective first and second lateral sides of the second panel;

a first release pin secured to and pivotably supported on one hinge plate of the first and second hinge plates at the first lateral side of the panels, and elastically biased toward engagement with the first and second hinge plates located at the first lateral side of the panels;

a second release pin secured to and pivotably supported on one hinge plate of the first and second hinge plates at the second lateral side of the panels, and elastically biased toward engagement with the first and second hinge plates located at the second lateral side of the panels;

first and second laterally spaced tracks;

a first roller supported on the first track and secured to one of the hinge plates of the first pair of hinge plates;

a second roller supported on the second track and secured to the other hinge plate of the first pair of hinge plates;

a third roller supported on the first track and secured to one of the hinge plates of the second pair of hinge plates; and a fourth roller supported on the second track and secured to the other hinge plate of the second pair of hinge plates; and wherein each member of the first hinge plate pair includes:

a first attachment plate secured to the first panel;

first and second legs, each leg extending from the first attachment plate and having first attachment hole aligned with the first attachment hole of the other leg;

wherein each member of the second hinge plate pair includes:

a second attachment plate secured to the second panel;

third and fourth legs, each leg extending from the second attachment plate and having a second attachment hole aligned with the second attachment hole of the other leg; and wherein each release pin includes a first axis and a second axis, a latch pin and spring aligned along the first axis, and first and second latch pins aligned along the second axis, said second axis spaced and parallel to the first axis, said spring for biasing said first and second latch pins toward engagement with the first and second hinge plates located on the same lateral side of the panels, so that the first release pin alternately disconnects and connects the first and second hinge plates at the first lateral side of the panels upon disengaging and engaging, respectively, the corresponding first and second attachment holes, and the second release pin alternately disconnects and connects the first and second hinge plates at the second lateral side of the panels upon disengaging and engaging, respectively, the corresponding first and second attachment holes.

2. The garage door assembly of claim 1, wherein the first and second attachment holes are latch holes; and the latch holes of each member of the first pair of hinge plates are able to be aligned with the latch holes of the second hinge plate member located on the same lateral side of the panels.

3. The garage door assembly of claim 2, further comprising:

a first center hinge plate secured to a center portion of the first panel and having a first pair of mutually aligned center plate attachment holes;

a second center hinge plate secured to a center portion of the second panel and having a second pair of mutually aligned center plate attachment holes; and a center release pin secured to and pivotably supported on one of the first and second center hinge plates, and being elastically biased toward engagement with the first and second center hinge plates for alternately disconnecting and connecting the first and second center hinge plates upon disengaging and engaging, respectively, the first pair and second pair of center plate attachment holes.

4. The garage door assembly of claim 1, wherein:

each member of the first and second hinge plate pairs further include, respectively, a sleeve for a roller shaft.

* * * * *